US011459217B2

(12) United States Patent
Herse

(10) Patent No.: US 11,459,217 B2
(45) Date of Patent: Oct. 4, 2022

(54) ROTARY TOWER CRANE

(71) Applicant: Liebherr-Werk Biberach GmbH, Biberach an der Riss (DE)

(72) Inventor: Thomas Herse, Biberach (DE)

(73) Assignee: Liebherr-Werk Biberach GmbH

( * ) Notice: Subject to any disclaimer, the term of this patent is extended or adjusted under 35 U.S.C. 154(b) by 0 days.

(21) Appl. No.: 16/643,459

(22) PCT Filed: Aug. 31, 2018

(86) PCT No.: PCT/EP2018/073463
§ 371 (c)(1),
(2) Date: Feb. 28, 2020

(87) PCT Pub. No.: WO2019/043156
PCT Pub. Date: Mar. 7, 2019

(65) Prior Publication Data

US 2020/0361753 A1 Nov. 19, 2020

(30) Foreign Application Priority Data

Sep. 1, 2017 (DE) ..... 20 2017 105 291.5
Nov. 30, 2017 (DE) ..... 20 2017 107 301.7

(51) Int. Cl.
*B66C 23/26* (2006.01)
*B66C 23/64* (2006.01)
(Continued)

(52) U.S. Cl.
CPC ..... *B66C 23/26* (2013.01); *B66C 23/64* (2013.01); *B66C 23/72* (2013.01); *B66C 23/82* (2013.01)

(58) Field of Classification Search
CPC ..... B66C 23/16; B66C 23/36; B66C 23/64; B66C 23/70; B66C 23/82
See application file for complete search history.

(56) References Cited

U.S. PATENT DOCUMENTS 3,706,285 A * 12/1972 Gynt ..... B66C 23/70 104/124
4,489,659 A * 12/1984 Kamohara ..... F16B 17/004 104/124
(Continued)

FOREIGN PATENT DOCUMENTS

CN 101434369 5/2009
CN 101880009 10/2010
(Continued)

OTHER PUBLICATIONS

CN 101880009A Machine Translation (Year: 2010).*
(Continued)

*Primary Examiner* — Michael R Mansen
*Assistant Examiner* — Juan J Campos, Jr.
(74) *Attorney, Agent, or Firm* — Troutman Pepper Hamilton Sanders LLP; Ryan A. Schneider

(57) ABSTRACT

A rotary tower crane with a tower, which carries a jib and a counterjib, with a jib stay being guided from a tower top to the jib and to the counterjib. The jib stay tensions only an inner jib portion, the length of which is less than 40% of the total length of the jib, and an outer portion, the length of which is more than 60% of the total length of the jib, forms an untensioned bending beam jib which includes at least one jib piece which tapers in height and which is adjoined on the inner side by at least one jib part of greater height and on the outer side by a jib piece of smaller height.

17 Claims, 2 Drawing Sheets

Figure 1:
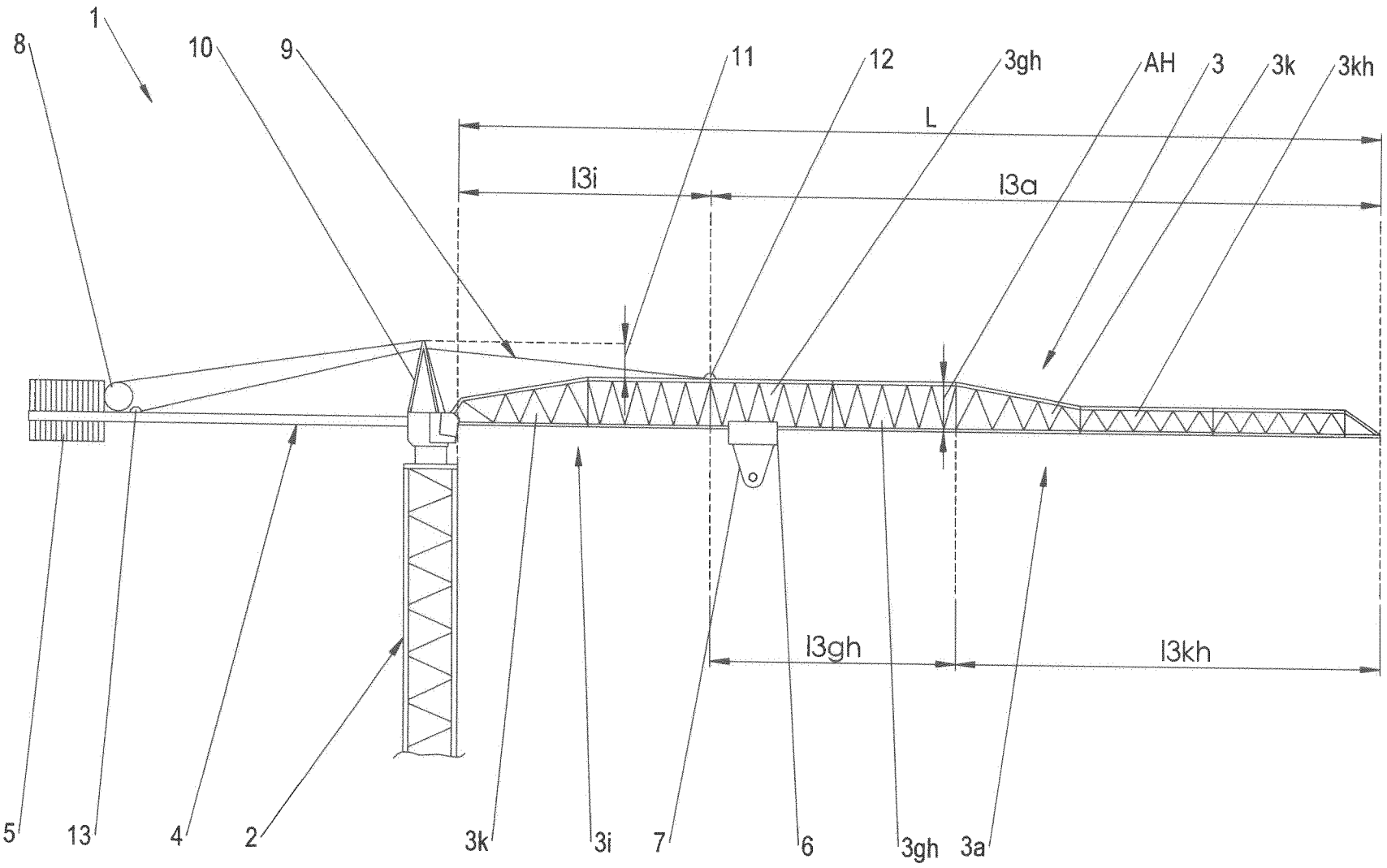

(51) Int. Cl.
*B66C 23/72* (2006.01)
*B66C 23/82* (2006.01)

(56) References Cited

U.S. PATENT DOCUMENTS

| | | | | |
|---|---|---|---|---|
| 10,822,742 | B2 * | 11/2020 | Mupende | D07B 1/04 |
| 2018/0238815 | A1 * | 8/2018 | Mupende | D07B 1/148 |

FOREIGN PATENT DOCUMENTS

| | | | | |
|---|---|---|---|---|
| CN | 101880009 | A * | 11/2010 | B66C 23/16 |
| DE | 3302378 | A1 | 8/1984 | |
| DE | 3331027 | | 3/1985 | |
| DE | 9218870 | U1 | 2/1996 | |
| DE | 60007467 | T2 | 12/2004 | |
| EP | 0384112 | A2 | 8/1990 | |
| EP | 0536061 | A1 | 4/1993 | |
| EP | 2041017 | A1 | 4/2009 | |
| EP | 2998264 | A1 | 3/2016 | |
| ES | 2264334 | A1 | 12/2006 | |
| FR | 2706882 | A1 | 12/1994 | |
| GB | 1311767 | A | 3/1973 | |
| GB | 2136759 | A | 9/1984 | |
| RU | 2258664 | C2 | 8/2005 | |
| SU | 1126530 | A1 | 11/1984 | |

OTHER PUBLICATIONS

Office Action from Chinese Application No. 201880070203.4 dated May 13, 2021.

German Search Report issued in application No. DE 20 2017 107 301.7 dated May 15, 2018.

International Search Report and Written Opinion issued in application No. PCT/EP2018/073463 dated Dec. 3, 2018.

Office Action from Russian Application No. 2020112227/11 (Feb. 6, 1985) dated Dec. 24, 2021.

* cited by examiner

ROTARY TOWER CRANE

The present invention relates to a revolving tower crane having a tower that supports a boom and a counterboom, wherein a boom guying is led from a tower top to the boom and to the counterboom.

It is known to guy the boom to be able to take up large loads with revolving tower cranes having relatively great radii, i.e. large boom lengths, with typically one, two, or also three guy ropes or guy bars being led from a tower top that projects above the boom to the boom and being fastened there. Depending on the boom length, the link points of the guy ropes or guy bars at the boom can be approximately central or can be disposed in an inner third and/or in an outer third. "Inner" here means a boom section disposed closer to the tower and "outer" means a boom section that projects further and is further spaced apart from the tower. For example, a first guy bar can be fastened at approximately one third of the total boom length and a second guy bar can be fastened at approximately two thirds of the total boom length. "Total" boom here means the boom without a counterboom, that is, that boom part on which the trolley travels.

If a counterboom that carries the ballast weight is present, the guying is typically also led rearwardly to this counterboom. With revolving tower cranes without a counterboom, the guying is led downwardly over the then rearwardly inclined tower top or guy brace.

Revolving tower cranes have also become popular more recently that dispense with such a boom guying and instead reinforce the boom itself so much that it can take up the forces as a bending beam boom. Such topless revolving tower cranes are sometimes called flat-top cranes or also hammer head cranes since they lack the tower top projecting above the boom. Important advantages of such topless revolving tower cranes are substantially the lower height and a simple installation routine.

Document EP 2 041 017 B1 shows such a topless revolving tower crane and proposes an assembly process for it that is intended to simplify the construction of the crane. Document DE 10 2005 018 522 B4 likewise shows such a topless revolving tower crane, wherein the bending beam boom, that is free of guying overall, should have a plurality of bearing points to be able to be installed at different points at the upper tower end such that the counterboom has a greater length at one time and a smaller length at another time. A further topless revolving tower crane is known, for example, from the document GB 14 93 715 or from the brochure "The EC-B Flat-Top Cranes" of Liebherr-Werk Biberach GmbH.

ES 22 64 334 A1 shows a comparison between a guyed revolving tower crane with a tower top and a topless flat-top crane. It is proposed therein to install the counterboom a little higher than the boom to further simplify the assembly.

Revolving tower cranes in which the boom guying is kept very short are known, for example, from the Spanish company of JASO under the type rating of the H series, for example model version J560. The boom there is relatively solid up to the boom tip to be able to take up the bending forces and bend torques that arise, which makes the crane relatively heavy and solid overall.

It is generally disadvantageous with topless revolving tower cranes that due to the high boom bending moments high component weights and dimensions of the boom components that are inconvenient to transport are required, in particular with large-dimension cranes >300 mt. To be able to receive the high boom bending moments, in particular in the inner boom section that is close to the tower, these further inwardly disposed boom parts require a large boom height and solidly dimensioned horizontal beams.

Starting from this, it is the underlying object of the present invention to provide an improved revolving tower crane of the initially named type which avoids disadvantages of the prior art and further develops the latter in an advantageous manner. A low height and a simple assembly capability should in particular be achieved without this having to be done at the cost of high component weights and excessive component geometries of the boom parts.

Said object is achieved in accordance with the invention by a revolving tower crane in accordance with claim 1. Preferred embodiments of the invention are the subject of the dependent claims.

It is therefore proposed only to guy a smaller, inner boom part via a relatively low tower top and to configure the larger, outer boom part as a bending beam boom without guying and to adapt the boom height to the loads that occur there. The outer, non-guyed boom part between the link point of the guying and the boom tip is in particular significantly tapered in its height so that the boom height of the non-guyed outer boom part becomes smaller toward the outside, i.e. with an increasing radius. Provision is made in accordance with the invention that the boom guying only guys an inner boom section whose length amounts to less than 40% of the total length of the boom and that an outer boom section whose length amounts to more than 60% of the total length of the boom forms a non-guyed bending beam boom that has at least one boom piece tapering in height which is adjoined at the inner side by at least one boom part of greater height and at the outer side by a boom piece of lesser height. At the inner side here means a boom part arranged closer to the tower and at the outer side means a boom part spaced further apart from the tower. The boom height means the vertical boom extent of the respective boom part from its lower edge up to its upper edge, which can be the vertical spacing from the bottom flange to the top flange on a configuration of the boom parts as a frame having top and bottom flanges.

The boom height of the non-guyed outer boom part that acts as a bending beam reduces remote from the tower and said non-guyed outer boom part can be configured as reduced in one stage or in multiple stages, wherein with a multi-stage tapering of the boom height, a plurality of conically tapering boom pieces can be provided between which a respective non-tapering boom piece can be provided that remains constant in height.

Alternatively to a stage-wise tapering of the boom height of the outer, non-guyed boom part, however, a continuous tapering of the boom height can also be provided in a further development of the invention that can extend over approximately the total length of the non-guyed, outer boom part or at least over a substantial piece thereof, for example over more than 50% or more than 75% of the length of the non-guyed outer boom part. The outer, non-guyed boom part can, for example, taper continuously and evenly in the boom height starting from the tie point of the guying up to the boom tip.

Advantageously, not only the most extreme part of the boom is reduced in boom height, but a reduction of the boom height is rather also already provided a lot closer to the boom tip. For example, a reduction of the boom height can already start at the center of the non-guyed outer boom part or even further inwardly disposed, for example at approximately a quarter or a third of the length of the outer, non-guyed boom part (when the length of the outer, non-guyed boom part is counted starting from the tower so that the length at the tie point of the guying would be 0% and the boom tip would have the length 100%).

If the boom is assembled, for example pinned or rigidly mounted to one another, from a plurality of respective rigid boom parts that can be configured as trussed girders, for example, the aforesaid conically tapering boom part can, for example, directly adjoin the guyed inner boom part or can be mounted thereto. Alternatively, initially at least one boom part of constant, relatively large boom height can be mounted to the inner, guyed boom part and the conically tapering boom piece can then be mounted thereto. A plurality of further boom parts can, for example, be mounted on the outer side of the conically tapering boom part than on the inner side of said conical boom part.

A part of the non-guyed outer boom part tapered in boom height can amount to more than a quarter or more than a third or also more than half the total length of the outer, non-guyed boom part, with, as said, the total outer, non-guyed boom part also being able to be conically tapered, for example. If the outer, non-guyed boom part is looked at, the length ratio between its inner section of greater height and its outer section of reduced height can be selected differently, with the inner boom section of greater height tending to be shorter than the outer section of reduced height. However, different length ratios can also be selected in which the inner boom section of greater height can be longer than the outer boom section of reduced height, with the sections of lesser and greater height here respectively meaning sections of the outer, non-guyed boom part.

The inner boom section of greater height (of the outer, non-guyed boom section) can in particular make up approximately 15% to 60%, preferably 30% to 40%, of the total length of the outer, non-guyed boom part, while the outer boom section of reduced height can have a length of 40% to 85%, in particular approximately 60% to 70%, of the total length of the non-guyed outer boom part.

The amount of the reduction of the boom height can be dimensioned differently, with, for example, a height reduction of at least 20% or of at least 30% or of at least 40% being able to be provided, i.e. the boom part of lesser height has a boom height of less than 80% or less than 70% or less than 60% of the boom height of the boom part of greater height. If only a conically tapering boom part is provided, its height at the outer end can, for example, amount to less than 80% or less than 70% or less than 60% of its height at the inner end.

The inner, guyed part of the boom can also be kept even shorter than the previously named 40% of the total length of the boom. Only the first third or the first quarter of the boom can, for example, also be guyed, i.e. the tie point of the outermost guy rope or of the outermost guy bar can be at 25% or 33% of the total length of the boom (when the length count is started at the tower, i.e. the boom section connected in an articulated manner to the tower has a length of 0% and the boom tip of 100%). The guying can optionally also be shortened even more so that the outermost guying point is, for example, at only 20% or 15% of the boom length.

If, for example, the total length of the boom is 80 m or more, the guying point—or with a plurality of tie points of a multi-bar guying, the outermost tie point—can be approximately 20-25 m.

The height of the tower top from where the guying is led to the boom can advantageously be kept very small in order not to significantly increase the height of the crane beyond the upper edge of the boom. The tower top can, for example, be less than twice as high as the boom height. The upper end of the tower top can, for example, be approximately 20% to 100% or 40% to 60% of the boom height above the top flange of the boom when the maximum boom height is set as 100%. If, for example, the maximum boom height is 2.5 m (which is only to be understood as a simple calculation example), the tower top can, for example, be 50 cm to 2.5 m or 1 m to 1.5 m above the upper edge of the boom.

Said tower top can here extend approximately vertically above the tower and so-to-say prolong it perpendicularly upward. Alternatively, the tower top can, however, also be inclined, for example arranged tilted to the rear toward the counterboom at an acute angle to the longitudinal axis of the tower or arranged tilted to the front toward the boom.

The guying can also be led to the rear to the counterboom and can there be fastened to the counterboom before the ballast weight. Due to the flat design of the guying, hoisting gear, in particular a hoist winch having a drive and optionally a transmission, can advantageously be arranged at the counterboom, in particular in a counterboom section that adjoins the ballast weight at the inner side and that is adjacent to the ballast weight. The hoisting gear can in particular be arranged between the ballast weight and the tie point of the guying at the counterboom. A positive distribution of the total weight and of the counterweight compensation, to which said hoist winch arrangement contributes, hereby results overall. The hoist winch or the hoisting gear can be spaced further apart from the tower than the tie point of the guying.

To further adapt the boom to the loads and to save weight, the inner, guyed boom part can also have a boom height varying over the length. The inner, guyed boom part can also in particular have at least one conically tapering boom part that can, for example, form the link piece by which the boom is connected to the tower in an articulated manner.

The section of the inner, guyed boom part tapering in boom height can advantageously amount to at least 30% or more than 40% of the total length of the inner, guyed boom part.

The tapering of the boom height of the inner, guyed boom part can be single-stage or multi-stage. Alternatively, the inner, guyed boom part can also be tapered continuously over substantially its total length in the boom height, with the boom height tapering toward the tower.

The boom can advantageously be configured as a frame boom in which a plurality of longitudinal beams are connected to one another by transverse braces. The boom can in particular be configured as a three-beam boom having a top flange and two bottom flanges as horizontal beams. Height strengths at low manufacturing costs can hereby be achieved, with a small windage area simultaneously being achieved, which is in particular important with large cranes having large radii.

Different materials can be used to be able to take up the forces in the boom, in particular in its horizontal beams, and also in the guying with a simultaneously low weight. The guying, on the one hand, and the boom, on the other hand, can in particular be formed from different materials.

The boom parts, in particular its top flanges and bottom flanges, can advantageously be produced from fine-grained steel, whereby pulsating loads can be easily taken up.

The guying can generally also be formed from steel, in particular from a steel bar or from a steel wire rope. The guying can, however, advantageously be built up of plastic fibers, in particular from a high-strength fiber rope or in the form of laminated plastic-reinforced guying bars.

Figure 2:
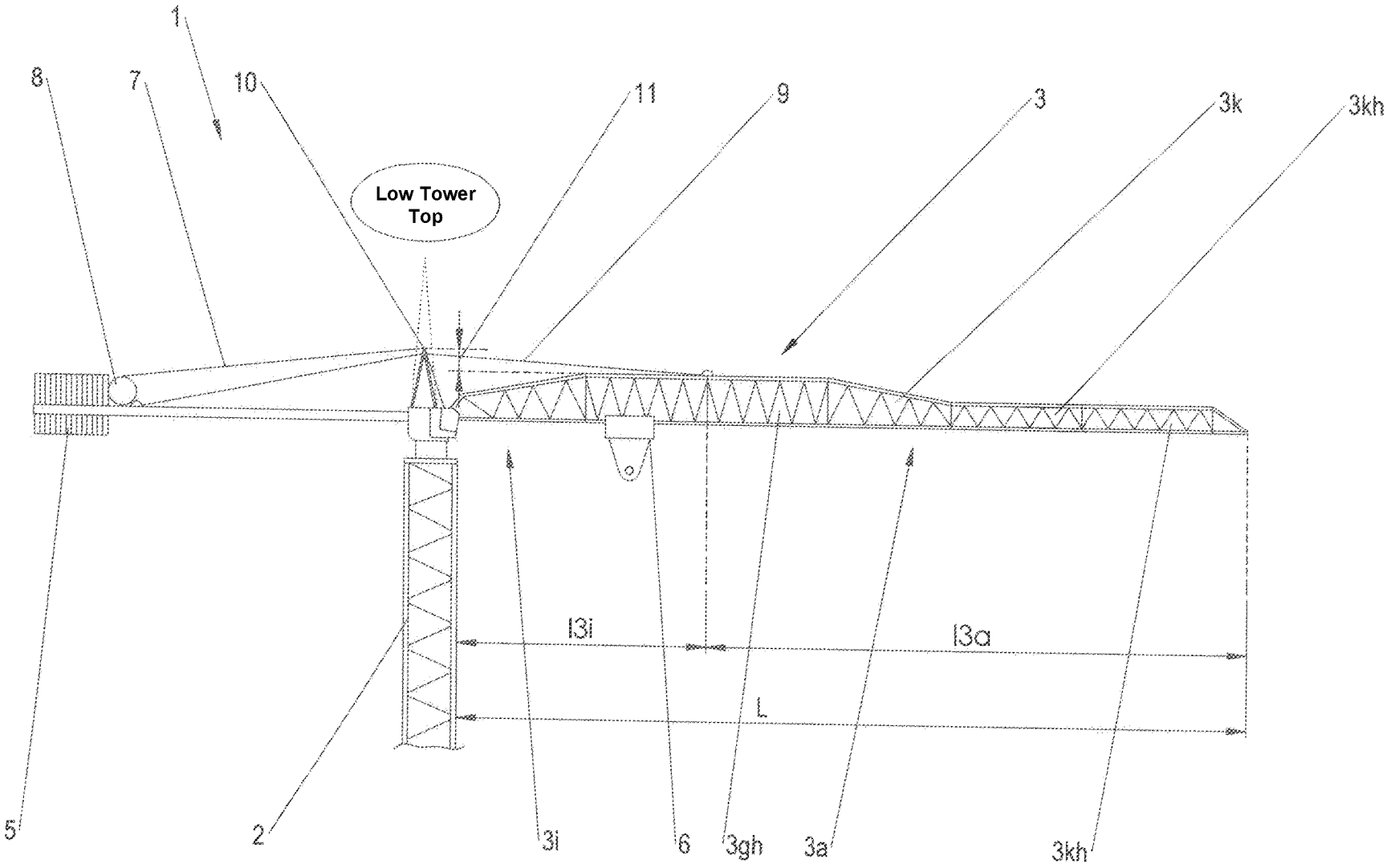

The invention will be explained in more detail in the following with respect to an embodiment and to associated drawings. There are shown in the drawing:

FIG. 1: a schematic side view of a revolving tower crane in accordance with an advantageous embodiment of the invention; and FIG. 2: a schematic side view of a revolving tower crane in accordance with a further advantageous embodiment of the invention in which the non-guyed, outer boom part consists of a plurality of boom parts in comparison with FIG. 1.

As FIG. 1 shows, the revolving tower crane 1 comprises an upright tower 2 that can be formed as a bar frame and can, for example, have a rectangular cross-section.

A boom 3, that is typically aligned in a level manner, in particular approximately horizontally, is connected to the upper end of the tower 2 in an articulated manner. A counterboom 4 that can likewise be arranged in a level manner, in particular horizontally, and that can support a ballast weight 5 can be provided at the side of the tower 2 opposite the boom 3.

A trolley 6 can be arranged longitudinally travelably in a manner known per se at the boom 3 to be able to lower and raise the hoist rope 7 and the lifting hook connected thereto closer to the tower 2 or further away from the tower 2. The hoist rope 7 can advantageously be lowered and raised with the aid of a hoisting gear 8 that can be arranged at the counterboom 4 in the vicinity of the ballast weight 5, in particular directly before the ballast weight 5.

As FIG. 1 shows, the boom 3 and the counterboom 4 are guyed by means of a guying 9, with said guying 9 being led over a tower top 10 or being fastened there. Said tower top 10 can extend upright upwardly beyond the boom 3 upright from the upper end of the tower 2 at which the boom 3 is connected in an articulated manner.

As FIG. 1 shows, said guying 9 is very flat and short so that the angle of inclination of the guying 9 that leads toward the boom 3 can only amount to a few degrees. The tower top 10 can in particular only project over the upper side of the boom 3 by a relatively small amount 11. Said protrusion 11 of the tower top 10 beyond the upper side of the boom 3 can, for example, in particular amount to approximately 20% to 100%, but can optionally also be in the range from 20% to 150% or 30% to 100% or 40% to 70% of the maximum boom height AH of the boom 3, cf. FIG. 1.

The link point 12 of the guying 9 at the boom 3 can be relatively close to the tower 2, with the spacing of said link point 12 from the tower 2 being able to amount to less than 40% or less than 30% or less than 20% of the total length of the boom 3. If the guying 9 is formed in multiple strands so that it has a plurality of link points at the boom 3, the outermost link point 12, i.e. the link point 12 furthest remote from the tower 2, is spaced apart from the tower 2 in said manner.

As FIG. 1 shows, the guying 9 can advantageously only have one link point at the boom 3, with nevertheless, viewed in a plan view, two guy ropes or guy bars being able to be provided that are fastened to the boom at the same distance from the tower. On use of a three-flange boom 3 having a top flange and two bottom flanges, it can, however, be advantageous only to use one guy rope or only one guy bar.

For example, with one crane having a total length of the boom 3 of 80 m or more, the link point 12 can be arranged at a spacing of approximately 20-24 m from the tower 2 so that an outer boom part 3*a* remaining without guying has a length of 60 m or more. It is understood that other boom lengths can generally be used with guying ratios that then remain the same in comparison.

Said outer, non-guyed boom part 3*a* can therefore be at least twice or also three times or also more than three times as long as the inner, guyed boom part 3*i* that extends from the tower 2 up to the outermost link point 2 of the guying 9.

As FIG. 1 shows, the boom height AH of the outer boom part 3*a* that remains non-guyed is adapted to the loads. The outer boom part 3*a* in particular has at least one conically tapering or vertically tapering boom part 3*k* whose inwardly disposed end has a larger boom height than its outer end. The inner end in turn means the end disposed closer to the tower 2 and the outer end means the end spaced further apart from the tower 2.

As FIG. 1 shows, a boom part 3*gh* having a relatively larger height can adjoin said boom part 3*k* that tapers conically toward the boom tip at the inner side and a boom part 3*kh* having a relatively smaller boom height can adjoin it at the outer side, with said greater boom height in particular being able to correspond to the height of the inner end of the conically tapering boom part 3*k* and said smaller boom height being able to correspond to the height of the outer end of the conical boom part 3*k*.

The inner boom part 3*gh* having the relatively greater height can here tend to be shorter than the outer boom part 3*kh* having the relatively smaller boom height. In principle, the length ratios of the boom parts having the greater and smaller heights can, however, generally be selected differently, with the inner boom part gh of a greater height advantageously being able to have a length $l_{3gh}$ that can be in the range from 15% to 60%, in particular approximately from 30% to 40%, of the total length $l_{3a}$ of the outer, non-guyed boom part 3*a*. The outer boom part 3*kg* having the relatively smaller height can in contrast have a length $l_{3kh}$ that can be in the range from 40% to 85%, in particular approximately from 60% to 70%, of the total length $l_{3a}$ of the outer, non-guyed boom part 3*a*, cf. FIG. 1.

As FIG. 1 shows, the boom parts inwardly and outwardly adjoining the conical boom part 3*k* can have respective constant boom heights AH so that the non-guyed, outer boom part 3*a* only has one tapering stage at which the boom height AH is reduced. Alternatively, however, it would likewise be possible to provide a plurality of respective conically tapering boom parts and accordingly a plurality of tapering stages at which the boom height of the outer, non-guyed boom part 3*a* reduces. Again alternatively to this, it would, however, also be possible that the outer, non-guyed boom part 3*a* continuously reduces in size or tapers in the boom height substantially over its total length, that is, from the link point 12 of the guying 9 up to the boom tip.

As FIG. 1 shows, the outer boom part 3*a* can respectively comprise two boom parts of greater height, two boom parts of smaller height, and said conical boom part.

As FIG. 2 shows, the vertical stage at which the boom height of the outer, non-guyed boom part reduces in size can, however, also be disposed further inwardly, for example such that only one boom part of greater height adjoins the conical boom at the inner side and two boom parts of smaller height adjoin it at the outer side. It would optionally also be conceivable to provide the conically tapered boom part directly at the link point 12 of the guying 9 and to install it directly at the guyed inner boom part 3*i*.

As FIG. 1 and FIG. 2 further show, the inner, guyed boom part 3*i* can also have at least one boom part 3*k* tapering in the boom height AH, with the boom height AG here reducing in size toward the tower 2. Said conical boom part 3*k* of the inner, guyed boom part 3*i* can in particular form the link piece of the boom 3 by which the boom 3 is connected to the tower 2 in an articulated manner.

The length of the tapering inner boom part can advantageously amount to more than 25% or more than 33% and also approximately 50% of the length of the inner, guyed boom part 3*i*.

The boom 3 can advantageously be built as a lattice carrier and can be composed of a plurality of rigid boom parts that are each rigidly connectable to one another, for example by a pin connection and/or by a latchable plug-in connection.

The boom parts can here advantageously each have a plurality of longitudinal beams that are rigidly connected to one another by transverse braces. The boom 3 can advantageously be built as a three-flange section that has a top flange and two bottom flanges as longitudinal beams.

The boom 3 can advantageously be built from steel sections that can in particular be produced from fine-grained steel.

The guying 9 advantageously comprises artificial fibers, with, for example, a high-strength fiber rope and/or a laminated, plastic-reinforced guy bar being able to be provided.

The revolving tower crane 1 can be configured as a top-slewer in which the boom 3 is slewable about an upright axis with respect to the tower 2. Alternatively, the revolving tower crane 1 can, however, also be configured as a bottom-slewer in which the boom 3 can be slewed about an upright axis with respect to the tower 2.

The invention claimed is:

1. A revolving tower crane comprising:

a tower having a tower top;

a boom comprising:

an inner, guyed boom section extending a length and comprising:

a first portion in proximity to the tower, the first portion extending a first portion length from a first portion first side to a first portion second side, and having a tapered height increasing from the first portion first side to the first portion second side; and a second portion extending a second portion length from a second portion first side in proximity to the first portion second side to a second portion second side, and having a non-tapered second portion height;

wherein a total length of the inner, guyed boom section is the combined lengths of the first portion length and the second portion length; and wherein the first portion length is from 25%-50% of the total length of the inner, guyed boom section; and an outer, non-guyed boom section extending a length and comprising:

an inner boom part in proximity to the second portion of the inner, guyed boom section, the inner boom part extending an inner boom part length from an inner boom part first side in proximity to the inner, guyed boom section second portion second side to an inner boom part second side, and having an inner boom part height; and an outer boom part extending an outer boom part length from an outer boom part first side in proximity to the inner boom part second side to an outer boom part second side, and having an outer boom part height;

wherein a total length of the outer, non-guyed boom section is the combined lengths of the inner boom part length and the outer boom part length; and a counterboom;

wherein the tower supports the boom, a boom guying being led from the tower top to the boom and to the counterboom;

wherein a total length of the boom is the combined lengths of the inner, guyed boom section and the outer, non-guyed boom section;

wherein the total length of the inner, guyed boom section amounts to less than 40% of the total length of the boom;

wherein the boom guying only guys the inner, guyed boom section;

wherein the outer, non-guyed boom section forms a non-guyed bending beam boom;

a first portion in proximity to the inner boom part, the first portion extending a first portion length from a first portion first side in proximity to the inner boom part second side to a first portion second side, and having a tapered height decreasing from the first portion first side to the first portion second side; and a second portion extending a second portion length from a second portion first side in proximity to the first portion second side to a second portion second side in proximity to the outer boom part second side, and having a second portion height;

wherein the inner boom part height is greater than the second portion height of the outer boom part; and wherein the outer boom part length is from 40% to 85% of the total length of the outer, non-guyed boom section.

2. The revolving tower crane in accordance with claim 1, wherein one or both:

the total length of the inner, guyed boom section amounts to less than 30% of the total length of the boom; and the total length of the outer, non-guyed boom section is from two to four times the length of the inner, guyed boom section.

3. The revolving tower crane in accordance with claim 1, wherein the tapered boom height of the of the first portion of the outer boom part of the outer, non-guyed boom section starts at a spacing from a link point of the boom guying at the boom, which distance corresponds to less than two thirds of the total length of the outer, non-guyed boom section.

4. The revolving tower crane in accordance with claim 1, wherein the inner boom part length is from 15% to 60% of the total length of the outer, non-guyed boom section.

5. The revolving tower crane in accordance with claim 1, wherein the outer boom part length is at least two thirds of the inner boom part length.

6. The revolving tower crane in accordance with claim 1, wherein the boom has a non-uniform height along its length being between a minimum and a maximum height; and wherein the boom height at the first portion second side of the first portion of the outer boom part is in the range from 50% to 90% of the maximum height of the boom.

7. The revolving tower crane in accordance with claim 1, wherein the tower top has a vertical protrusion;

wherein the boom has an upper side and a non-uniform height along its length being between a minimum and a maximum height; and wherein the vertical protrusion of the tower top extends beyond the upper side of the boom, which vertical protrusion amounts to from 20% to 100% of the maximum height of the boom.

8. The revolving tower crane in accordance with claim 1, wherein the boom is formed as a frame section having three longitudinal beams that are rigidly connected to one another, with the longitudinal beams having a top flange and two bottom flanges.

9. The revolving tower crane in accordance with claim 1, wherein the boom is produced from steel sections and the boom guying comprises a plastic fiber structure in the form of a high-strength fiber rope and/or a laminated plastic fiber-reinforced bar section.

10. The revolving tower crane in accordance with claim 1 further comprising a hoisting gear arranged at the counterboom to raise and lower a guy rope.

11. A revolving tower crane comprising:

a tower having a tower top;

a boom comprising:

an inner, guyed boom section extending a length; and an outer, non-guyed boom section extending a length;

wherein a total length of the boom is the combined lengths of the inner, guyed boom section and the outer, non-guyed boom section;

a counterboom; and a hoisting gear arranged at the counterboom to raise and lower a guy rope;

wherein:

the tower supports the boom, a boom guying being led from the tower top to the boom and to the counterboom;

the hoisting gear is fastened to the counterboom between a ballast weight that is fastened to the counterboom and a link point of the boom guying;

the boom guying only guys the inner, guyed boom section;

the inner, guyed boom section comprises:

a first portion in proximity to the tower, the first portion extending a first portion length from a first portion first side to a first portion second side, and having a tapered height increasing from the first portion first side to the first portion second side; and a second portion extending a second portion length from a second portion first side in proximity to the first portion second side to a second portion second side, and having a non-tapered second portion height;

wherein:

a total length of the inner, guyed boom section is the combined lengths of the first portion length and the second portion length; and the first portion length is from 25%-50% of the total length of the inner, guyed boom section;

the outer, non-guyed boom section comprises:

an inner boom part in proximity to the second portion of the inner, guyed boom section, the inner boom part extending an inner boom part length from an inner boom part first side in proximity to the inner, guyed boom section second portion second side to an inner boom part second side, and having an inner boom part height; and an outer boom part extending an outer boom part length from an outer boom part first side in proximity to the inner boom part second side to an outer boom part second side, and having an outer boom part height;

wherein a total length of the outer, non-guyed boom section is the combined lengths of the inner boom part length and the outer boom part length;

the outer boom part of the outer, non-guyed boom section comprises:

a first portion in proximity to the inner boom part, the first portion extending a first portion length from a first portion first side in proximity to the inner boom part second side to a first portion second side, and having a tapered height decreasing from the first portion first side to the first portion second side; and a second portion extending a second portion length from a second portion first side in proximity to the first portion second side to a second portion second side in proximity to the outer boom part second side, and having a second portion height; and the inner boom part height is greater than the second portion height of the outer boom part.

12. The revolving tower crane in accordance with claim 11, wherein one or both:

the total length of the inner, guyed boom section amounts to less than 30% of the total length of the boom; and the total length of the outer, non-guyed boom section is from two to four times the length of the inner, guyed boom section.

13. The revolving tower crane in accordance with claim 11, wherein the tapered boom height of the of the first portion of the outer boom part of the outer, non-guyed boom section starts at a spacing from the link point of the boom guying at the boom, which distance corresponds to less than two thirds of the total length of the outer, non-guyed boom section.

14. The revolving tower crane in accordance with claim 11, wherein one or both:

the inner boom part length is from 15% to 60% of the total length of the outer, non-guyed boom section; and the outer boom part length is from 40% to 85% of the total length of the outer, non-guyed boom section.

15. The revolving tower crane in accordance with claim 11, wherein the boom has a non-uniform height along its length being between a minimum and a maximum height; and wherein the boom height at the first portion second side of the first portion of the outer boom part is in the range from 50% to 90% of the maximum height of the boom.

16. The revolving tower crane in accordance with claim 11, wherein the tower top has a vertical protrusion;

wherein the boom has an upper side and a non-uniform height along its length being between a minimum and a maximum height; and wherein the vertical protrusion of the tower top extends beyond the upper side of the boom, which vertical protrusion amounts to from 20% to 100% of the maximum height of the boom.

17. A revolving tower crane comprising:

a tower having a tower top having a vertical protrusion;

a boom comprising:

an inner, guyed boom section extending a length; and an outer, non-guyed boom section extending a length;

wherein:

a total length of the boom is the combined lengths of the inner, guyed boom section and the outer, non-guyed boom section;

the length of the inner, guyed boom section amounts to less than 40% of the total length of the boom;

the length of the outer, non-guyed boom section is from two to four times the length of the inner, guyed boom section;

the boom has a non-uniform height along its length being between a minimum and a maximum height; and the vertical protrusion of the tower top extends beyond an upper side of the boom, which vertical protrusion amounts to from 20% to 100% of the maximum height of the boom;

a counterboom; and a hoisting gear arranged at the counterboom to raise and lower a guy rope;

wherein:

the tower supports the boom, a boom guying being led from the tower top to the boom and to the counterboom;

the hoisting gear is fastened to the counterboom between a ballast weight that is fastened to the counterboom and a link point of the boom guying;

the boom guying only guys the inner, guyed boom section;

the inner, guyed boom section comprises:

a first portion in proximity to the tower, the first portion extending a first portion length from a first portion first side to a first portion second side, and having a tapered height increasing from the first portion first side to the first portion second side; and a second portion extending a second portion length from a second portion first side in proximity to the first portion second side to a second portion second side, and having a non-tapered second portion height;

wherein:

the length of the inner, guyed boom section is the combined lengths of the first portion length and the second portion length; and wherein the first portion length is from 25%-50% of the length of the inner, guyed boom section;

the outer, non-guyed boom section comprises:

an inner boom part in proximity to the second portion of the inner, guyed boom section, the inner boom part extending an inner boom part length from an inner boom part first side in proximity to the inner, guyed boom section second portion second side to an inner boom part second side, and having an inner boom part height; and an outer boom part extending an outer boom part length from an outer boom part first side in proximity to the inner boom part second side to an outer boom part second side, and having an outer boom part height;

wherein:

the length of the outer, non-guyed boom section is the combined lengths of the inner boom part length and the outer boom part length;

the inner boom part length is from 15% to 60% of the length of the outer, non-guyed boom section; and the outer boom part length is at least two thirds of the inner boom part length;

the outer boom part of the outer, non-guyed boom section comprises:

a first portion in proximity to the inner boom part, the first portion extending a first portion length from a first portion first side in proximity to the inner boom part second side to a first portion second side, and having a tapered height decreasing from the first portion first side to the first portion second side; and a second portion extending a second portion length from a second portion first side in proximity to the first portion second side to a second portion second side in proximity to the outer boom part second side, and having a second portion height;

wherein the tapered boom height of the of the first portion of the outer boom part of the outer, non-guyed boom section starts at a spacing from the link point of the boom guying at the boom, which distance corresponds to less than two thirds of the length of the outer, non-guyed boom section;

the inner boom part height is greater than the second portion height of the outer boom part; and the boom height at the first portion second side of the first portion of the outer boom part is in the range from 50% to 90% of the maximum height of the boom.

* * * * *